US005962369A

United States Patent [19]

Oldfield et al.

[11] Patent Number: 5,962,369

[45] Date of Patent: Oct. 5, 1999

[54] THERMAL DYE TRANSFER DYE-DONOR ELEMENT WITH TRANSFERABLE PROTECTION OVERCOAT

[75] Inventors: Mary Catherine S. Oldfield, Rochester; William H. Simpson, Pittsford; Kin K. Lum, Webster, all of N.Y.

[73] Assignee: Eastman Kodak Company, Rochester, N.Y.

[21] Appl. No.: 09/103,598

[22] Filed: Jun. 24, 1998

[51] Int. Cl.[6] ..... B41M 5/035; B41M 5/38

[52] U.S. Cl. ..... 503/227; 428/195; 428/447; 428/500; 428/704; 428/913; 428/914

[58] Field of Search ..... 8/471; 428/195, 428/447, 500, 704, 913, 914; 503/227

[56] References Cited

U.S. PATENT DOCUMENTS

| | | | |
|---|---|---|---|
| 4,737,486 | 4/1988 | Henzel | 503/227 |
| 5,668,081 | 9/1997 | Simpson et al. | 503/227 |

*Primary Examiner*—Bruce H. Hess
*Attorney, Agent, or Firm*—Harold E. Cole

[57] ABSTRACT

A dye-donor element for thermal dye transfer comprising a support having thereon a coextensive subbing layer and at least one dye layer area comprising an image dye in a binder and another area comprising a transferable protection layer, the transferable protection layer area being approximately equal in size to the dye layer area, the transferable protection layer having associated therewith a release material comprising a multi-hydroxyl compound, the alkali or alkaline earth metal salt of an alkyl diphenyloxide disulfonate, or an organic phosphate ester.

20 Claims, No Drawings

THERMAL DYE TRANSFER DYE-DONOR ELEMENT WITH TRANSFERABLE PROTECTION OVERCOAT

FIELD OF THE INVENTION

This invention relates to a dye-donor element for thermal dye transfer, and more particularly to the use of a transferable protection overcoat in the element for transfer to a thermal print.

BACKGROUND OF THE INVENTION

In recent years, thermal transfer systems have been developed to obtain prints from pictures which have been generated electronically from a color video or digital print camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. Also, dye fading may occur from fingerprint marking because the image dyes are located at the surface. These dyes can be driven further into the dye-receiving layer by thermally fusing the print with either hot rollers or a thermal head. This will help to reduce dye retransfer and fingerprint susceptibility, but does not eliminate these problems. However, the application of a protective overcoat will practically eliminate these problems.

DESCRIPTION OF RELATED ART

U.S. Pat. No. 4,737,486 relates to the use of tetraalkyl titanates, such as Tyzor TBT® from DuPont Co., as a subbing layer on a polyester substrate to enhance the adhesion of subsequently coated polymeric binders in a thermal dye-donor element.

U.S. Pat. No. 5,668,081 discloses a dye-donor element for thermal dye transfer containing cyan, magenta and yellow dye patches wherein a transparent protection overcoat is also present on the element which is used to form a protective layer over the printed image. These protective overcoats work very well with thermally printed material which is used as a photographic reproduction.

However, there is a problem with using a protection layer in a dye-donor element which has been subbed in that the protection layer adheres too strongly to the support. In order to take advantage of the need for a subbing layer to increase adhesion of the dye patches, yet being able to use a protection layer, it has been necessary to patch coat the subbing layer only on the areas of the support where the dye layer is present. The patch coating of the subbing layer is difficult in manufacturing.

The primary function of a subbing layer is to prevent the physical transfer of the dye layer binder to the receiver through adhesive failure of the layer. When the dye-donor element contains a protective layer patch, the opposite effect is desired, namely, the protective layer patch should release from the support and be transferred to the receiver during processing. If the subbing layer used for the dye patches enhances adhesion of the protective layer patch to the donor support, the subbing layer must be coated so that there is no material coated under the protective layer patch. Extreme care must be exercised during the manufacturing operation to maintain registration of the dye patches onto the subbed support and the protective layer patch onto the unsubbed support. The operation becomes costly when the coating machine looses registration and the edge of a dye patch is coated on an unsubbed portion of the support.

It is an object of this invention to provide a protective layer for a thermal dye transfer image which can be applied by the thermal print head and releases from a subbed donor support.

SUMMARY OF THE INVENTION

This and other objects are achieved in accordance with this invention which relates to a dye-donor element for thermal dye transfer comprising a support having thereon a coextensive subbing layer and at least one dye layer area comprising an image dye in a binder and another area comprising a transferable protection layer, the transferable protection layer area being approximately equal in size to the dye layer area, the transferable protection layer having associated therewith a release material comprising a multihydroxyl compound, the alkali or alkaline earth metal salt of an alkyl diphenyloxide disulfonate, or an organic phosphate ester.

In accordance with the invention, a subbing material such as Tyzor TBT®, can be coated in a continuous manner under both the dye patches and protective layer patch but still allows the protective layer patch to be released in the printing process while maintaining good adhesion for the dye patches. The need for critical registration of the subbing layer during coating is eliminated, waste and cost are reduced, giving the process a significant advantage over that of coating the subbing layer in non-continuous patches.

DETAILED DESCRIPTION OF THE INVENTION

In a preferred embodiment of the invention, the dye-donor element is a multicolor element comprising repeating color patches of yellow, magenta and cyan image dyes, respectively, dispersed in a binder, and a patch containing the protection layer. A black layer patch could also be added if desired.

In another embodiment of the invention, the protection layer is the only layer on a donor element and is used in conjunction with another dye-donor element which contains the image dyes.

In another preferred embodiment of the invention, the dye-donor element is a monochrome element and comprises repeating units of two areas, the first area comprising a layer of one image dye dispersed in a binder, and the second area comprising the protection layer.

In another preferred embodiment of the invention, the dye-donor element is a black-and-white element and comprises repeating units of two areas, the first area comprising a layer of a mixture of image dyes dispersed in a binder to produce a neutral color, and the second area comprising the protection layer.

Examples of multi-hydroxy release materials which can be used in association with a protection layer in the invention include the following:

glycerol, sorbitol [$CH_2OH(CHOH)_4CH_2OH$], triethanol amine, etc.

Examples of an alkali or alkaline earth metal salt of an alkyl diphenyloxide disulfonate which can be used in the invention include:

potassium dodecyl diphenyloxide disulfonate, sodium nonyl diphenyloxide disulfonate, calcium decyl diphenyloxide disulfonate, lithium octyl diphenyloxide disulfonate, sodium dodecyl diphenyloxide disulfonate, sold commercially as Dowfax 2A1® from Dow Chemical Co. having the following structure:

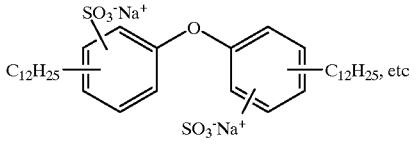

Examples of organic phosphate esters which can be used in the invention include:

polyoxyethylene nonylphenol ether, branched phosphate, sold commercially as Rhodafac® PE510 (Rhone-Pouloc Co.), free acid of complex organic phosphate ester, sold commercially as Laurelphos® E-61 (Reilly-Whiteman Inc.), free acid of complex organic phosphate ester, sold commercially as DeSophos® 5AP (Witco Corp.), aromatic phosphate ester sold commercially as Maphos® 55 (PPG Industries), etc. Mixtures of the above release materials may also be used.

The release material may be employed at a minimum concentration of at least about 0.01 g/m$^2$. An upper concentration for the release material would be approximately equivalent to the binder concentration. In general, the concentration of the release material is from about 0.01 g/m$^2$ to about 0.5 g/m$^2$, preferably from about 0.05 to about 0.3 g/m$^2$.

As noted above, the release material is associated with the protection layer. In a preferred embodiment of the invention, the release material is added to the protection layer itself. Alternatively, the release material could be added as a primer coat underneath the protection layer and on top of the subbing layer if desired.

Binders which may be employed in the element include poly(vinyl formal), poly(vinyl benzal), phenoxy resins, polystyrene, cellulose acetate, etc. In a preferred embodiment, poly(vinyl acetal) or poly(methyl methacrylate) is employed. Examples of a poly(vinyl formal), poly(vinyl benzal) or poly(vinyl acetal) are disclosed in the above-mentioned U.S. Pat. No. 5,332,713, the disclosure of which is hereby incorporated by reference.

The present invention provides a protective overcoat layer applied to a thermal print by uniform application of heat using a thermal head. After transfer to the thermal print, the protective layer provides superior protection against image deterioration due to exposure to light, common chemicals, such as grease and oil from fingerprints, and plasticizers from film album pages or sleeves made of poly(vinyl chloride). The protection layer is generally applied in a concentration of at least about 0.5 g/m$^2$.

Yellow, magenta and cyan dyes can be thermally transferred from a dye-donor element to form a multicolor image on the dye-receiving -sheet. The thermal head is then used to transfer a clear protective layer, from another clear patch on the dye-donor element or from a separate donor element, onto the imaged receiving sheet by uniform application of heat. The clear protective layer adheres to the print and is released from the donor support in the area where heat is applied.

The subbing layer employed in the invention may be present in any concentration which is effective for the intended purpose. In general, good results have been attained using a laydown of from about 0.01 g/m$^2$ to about 0.3 g/m$^2$, preferably 0.02 g/m$^2$ to 0.15 g/m$^2$.

Any image dye can be used in the dye-donor employed in the invention, provided it is transferable to the dye-receiving layer by the action of the thermal print head or laser. Especially good results have been obtained with sublimable dyes such as

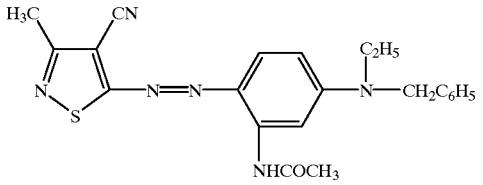

Magenta Dye M-1

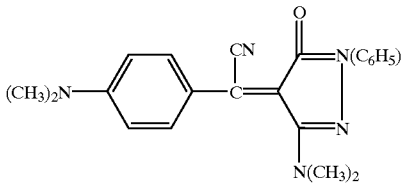

Magenta Dye M-2

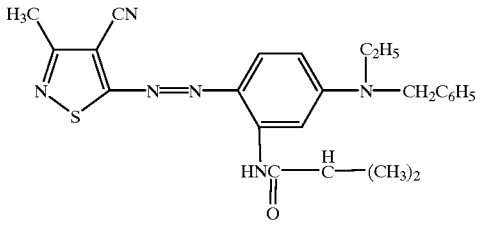

Magenta Dye M-3

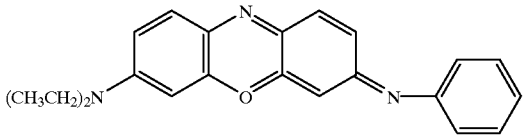

Magenta Dye M-4

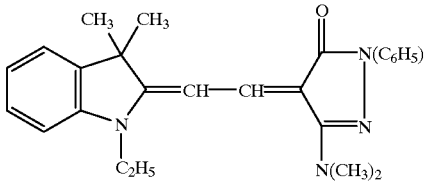

Yellow Dye Y-1

-continued

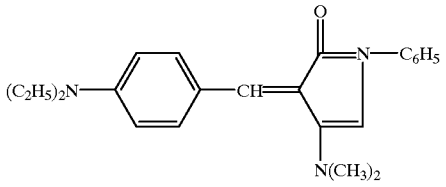

Yellow Dye Y-2

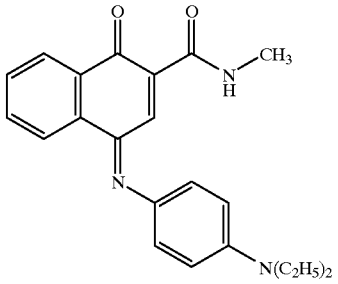

Cyan Dye C-1

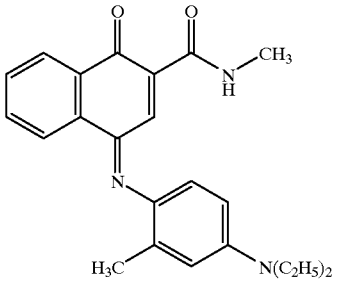

Cyan Dye C-2

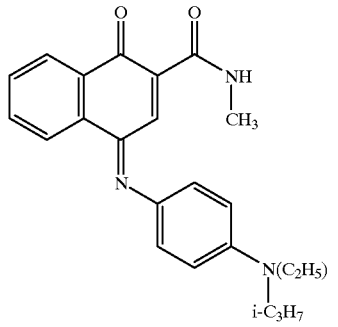

Cyan Dye C-3 or any of the dyes disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. The above dyes may be employed singly or in combination. The dyes may be used at a coverage of from about 0.05 to about 5 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

Any material can be used as the support for the dye-donor element of the invention provided it is dimensionally stable and can withstand the heat of the laser or thermal head. Such materials include polyesters such as poly(ethylene terephthalate); poly(ethylene naphthalate); polyamides; polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimideamides and polyetherimides. The support generally has a thickness of from about 5 to about 200 $\mu$m and may also be coated with a subbing layer, if desired, such as those materials described in U.S. Pat. Nos. 4,695,288 or 4,737,486.

The reverse side of the dye-donor element is usually coated with a slipping layer to prevent the print head from sticking to the dye-donor element. Such a slipping layer would comprise either a solid or liquid lubricating material or mixtures thereof, with or without a polymeric binder or a surface-active agent. Preferred lubricating materials include oils or semicrystalline organic solids that melt below 100° C. such as poly(vinyl stearate), beeswax, microcrystalline wax, perfluorinated alkyl ester polyethers, polycaprolactone, silicone oils, polytetrafluoroethylene, carbowaxes, poly (ethylene glycols), or any of those materials disclosed in U.S. Pat. Nos. 4,717,711; 4,717,712; 4,737,485; and 4,738,950, and EP 285,425, page 3, lines 25–35. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used. The dye-receiving element may also comprise a solid, injection-molded material such as a polycarbonate, if desired.

The dye image-receiving layer may comprise, for example, a polycarbonate, a polyurethane, a polyester, poly (vinyl chloride), poly(styrene-co-acrylonitrile), polycaprolactone, a poly(vinyl acetal) such as poly(vinyl alcohol-co-butyral), poly(vinyl alcohol-co-benzal), poly (vinyl alcohol-co-acetal) or copolymers or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830; 4,541,830; 4,698,651; 4,695,287; 4,701,439; 4,757,046; 4,743,582; 4,769,360; and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal print heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

The following examples are provided to illustrate the invention.

EXAMPLES

Example 1

Protection layer-donor elements were prepared by coating on a 6 $\mu$m poly(ethylene terephthalate) support:

1) a subbing layer of titanium butoxide (DuPont Tyzor TBT)® (0.13 g/m$^2$) from a n-propyl acetate and n-butyl alcohol solvent mixture (85/15), and 2) a protection layer of a binder (0.54 g/m$^2$) of either KS-1 or KS-10 polyvinyl acetal from Sekisui, or poly(methyl methacrylate) (PMMA), divinylbenzene beads (4 $\mu$m) (0.09 g/m$^2$) and a release additive from an appropriate solvent combination as described in Table 1 below.

TAGBLE 1

| Example | Binder | Additive (g/m$^2$) | Solvent |
|---|---|---|---|
| Control 1 | KS-1 | None | Diethylketone |
| Control 2 | KS-1 | None | Methanol |
| Control 3 | KS-1 | | Methanol + 5% water |
| Control 4 | KS-1 | None | Diethylketone + 5% water |
| Control 5 | KS-l | Triethylamine (0.11) | Diethylketone |
| Control 6 | PMMA | None | Methylethylketone/ methanol (62.5/37.5) |
| Control 7 | KS-10/IPA-ST* (0.39 g/m$^2$) | None | Diethyl ketone/ Isopropanol (80/20) |
| Example 1 | KS-1 | Triethanolamine (0.11) | Diethylketone |
| Example 2 | KS-1 | Glycerol (0.11) | Methanol |
| Example 3 | KS-1 | Glycerol (0.11) | Methanol + 5% water |
| Example 4 | KS-1 | Sorbitol (0.22) | Methanol + 5% water |
| Example 5 | KS-1 | Glycerol (0.11) + Sorbitol (0.11) | Methanol + 5% water |
| Example 6 | KS-1 | Glycerol (0.11) + Sorbitol (0.22) | Methanol + 5% water |
| Example 7 | PMMA | Dowfax 2A1 ® (0.054) | Methylethylketone/ methanol (62.5/37.5) |
| Example 8 | PMMA | Dowfax 2A1 ® (0.11) | Methylethylketone/ methanol (62.5/37.5) |
| Example 9 | KS-10/IPA-ST* (0.39 g/m$^2$) | Dowfax 2A1 ® (0.054) + Sorbitol (0.054) | Methanol/ water/isopropanol (76/5/19) |
| Example 10 | KS-10/IPA-ST* (0.39 g/m$^2$) | Rhodofac ® PE510 (0.11) | Isopropanol/ Methanol (20/80) |

*IPA-ST = Colloidal silica in isopropanol (Nissan Chemical Co.) instead of divinylbenzene beads On the back side of the element were coated the following layers in sequence:

1) a subbing layer of titanium butoxide (DuPont Tyzor TBT)® (0.13 g/m$^2$) from n-propyl acetate and n-butyl alcohol solvent mixture (85/15), and 2) a slipping layer containing an aminopropyl-dimethyl-terminated polydimethylsiloxane, PS513® (United Chemical Technologies, Bristol, Pa.)(0.01 g/m$^2$), a poly (vinyl acetal) binder (0.38 g/m$^2$), p-toluenesulfonic acid (0.0003 g/m$^2$), candelilla wax (0.02 g/m$^2$), coated from a solvent mixture of diethylketone, methanol and distilled water (88.7/9.0/2.3).

Receiver Element

The receiver element consisted of three layers coated on Eastman Kodak Electronic Print Paper (Eastman Kodak Co.) support as described in U.S. Pat. Nos. 5,387,574 and 5,350,733. Since the important interaction for successful transfer of a protective layer takes place between protective layer and the topmost layer of the receiver element, the support of the latter acts only as a carrier of the receiver layers and may consist of any material compatible with the bottom-most receiver layer.

The first layer, which was coated directly on the support consisted of 0.1076 g/m$^2$ Prosil 221®, an aminopropyltriethoxysilane, (PCR Inc.) and 0.1076 g/m$^2$ Prosil® 2210, a proprietary epoxy trialkoxy silane, (PCR Inc.).

The second layer consisted of Makrolon® KL3-1013 (Bayer AG) at 1.52 g/m$^2$, Lexan® 141-112 polycarbonate (General Electric Co.) at 1.24 g/m$^2$, FC431 fluorocarbon surfactant (3M Corp.) at 0.0093 g/m$^2$, dibutyl phthalate (Eastman Kodak) at 0.28 g/m$^2$, and diphenylphthalate at 0.28 g/m.

The third, and top-most layer of the receiver element consisted of a copolymer of 50 mole-% bisphenol A, 49 mole-% diethylene glycol and 1 mole-% of a poly (dimethylsiloxane) block at a laydown of 0.65 g/m$^2$, FC431 at 0.022 g/m$^2$, and DC510 silicone fluid surfactant (Dow Corning) at 0.0027 g/m$^2$.

Testing/Printing Conditions:

The protective layer donor element samples were tested for release from the donor supports by two methods. The first method was a Scotch® tape pull test. A four inch length of ¾ inch wide Scotch® tape was pressed onto the coating surface perpendicular to coating direction. The tape was peeled off and the coating sample was inspected for removal of the coated surface. The test was conducted at room temperature and ambient humidity. This was repeated four times. The results of the test are shown in Table 2 below.

The second test was a printing test. The protective layer donor element samples were printed to a dye diffusion transfer receiver to test for print release of the protective layer from the donor support. A Kodak XLS8600 print engine was used for the evaluation.

The protective layer dye donor element was placed in contact with the polymeric receiving layer side of the receiver element. The assemblage was positioned on an 18 mm platen roller and a TDK LV5406A thermal head with a head load of 6.35 Kg was pressed against the platen roller.

The TDK LV5406A thermal print head has 2560 independently addressable heaters with a resolution of 300 dots/inch and an average resistance of 3516 Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 58 μsec every 76 μsec. Printing maximum density required 64 pulses "on" time per printed line of 5.0 msec. The voltage supplied at 13.9 volts resulted in an instantaneous peak power of approximately 54.95× 10−3 Watt/dot and the maximum total energy required to print Dmax was 0.204 mJoules/dot.

This printing process heated the protective layer donor element uniformly with the thermal head to permanently adhere the protective layer to the imaged receiver. The donor support was peeled away as the printer advanced through its heating cycle, leaving the protective layer adhered to the imaged receiver. The condition of the imaged receiver having a protective layer was observed and the results recorded in the Table 2 below.

Printer Test

1=Uniform transfer with no printer problems

2=Uniform transfer but donor pulls out of printer with receiver

3=Mostly transferred but donor pulls out of printer with receiver

4=Partial transfer but donor pulls out of printer with receiver

5=No transfer of Protective Layer

TABLE 2

| Element | Scotch ® Tape Pull Test (# released/# tries) | Printer Release |
|---|---|---|
| Control 1 | 0/4 | 5 |
| Control 2 | 0/4 | 5 |
| Control 3 | 4*/4 | 4 |
| Control 4 | 0/4 | 5 |
| Control 5 | 0/4 | 5 |
| Control 6 | 0/4 | 5 |
| Control 7 | 0/4 | 5 |
| Example 1 | 4/4 | 1 |
| Example 2 | 4/4 | 1 |
| Example 3 | 4*/4 | 1 |
| Example 4 | 4/4 | 1 |
| Bxample 5 | 4/4 | 1 |
| Example 6 | 4/4 | 2 |
| Example 7 | 4/4 | 2 |
| Example 8 | 4/4 | 1 |
| Example 9 | 4/4 | 1 |
| Example 10 | 4/4 | 1 |

*partial release

Control 1 shows that coating a polyvinylacetal protective layer over a subbing layer of Tyzor TBT® gives strong adhesion of the protective layer to the donor support since no release was seen with Scotch® tape in four tries and no release of the protective layer was observed in the printer test.

Control 2 indicates that incorporation of an organic solvent containing a hydroxy group into the coating solution does not cause the protective layer to release.

Control 3 indicates that incorporation of water into the methanol solvent results in a partial release of the protective layer from its support (tape test) but also results in the unwanted adhesion of the donor to the receiver in the printer.

Control 4 shows that incorporation of water in the diethyl ketone solvent has neither a positive or negative effect.

Control 5 shows that using an amine group similar to that found in Example 1 does not result in the release of the protective layer from its support.

Control 6 indicates that when polymethylmethacrylate is used as the protective layer binder coated over a Tyzor TBT® subbing layer, there is no release.

Control 7 indicates that incorporation of a colloidal silica into a lower molecular weight poly(vinyl acetal) binder does not result in release from a support subbed with Tyzor TBT®.

Examples 1 through 6 of the invention indicate that incorporation of an organic material in the form of triethanol amine, glycerol or sorbitol into the coating solvent of the protective layer results in release by tape test four times for four tries and in the printer test showed uniform transfer.

Example 7 and 8 show that incorporation of an organic material such as Dowfax2A1® into the coating solution of a polymethylmethacrylate binder results in release four times for four tries in the tape test and in the printer test showed uniform transfer.

Example 9 shows that when Dowfax 2A1® and sorbitol are added in combination at a lower laydown than the single materials results in release four times for four tries in the tape test and in the printer test showed uniform transfer.

Example 10 shows that the addition of Rhodafac® PE510 into the coating solution of a protective layer results in release four times for four tries in the tape test and in the printer test showed uniform transfer.

Example 2

Example 1 was repeated except that the subbing layer on the front side of the element was of 0.05 g/m$^2$ Prosil 221® silane and 0.05 g/m$^2$ Prosil® silane coated from a 97% ethyl alcohol (3A) and 3% water mixture.

The following elements were prepared:

TABLE 3

| Example | Binder | Additive ($g/m^2$) | Solvent |
|---|---|---|---|
| Control 8 | KS-10/IPA-ST (0.39 $g/m^2$) | None | Diethyl ketone/isopropanol (80/20) |
| Example 11 | KS-10/IPA-ST (0.39 $g/m^2$) | Dowfax 2A1 ® (0.054) + Sorbitol (0.054) | Methanol/ water/isopropanol (75/5/20) |

The elements were tested as in Example 1 with the following results:

TABLE 4

| Element | Scotch ® Tape Pull Test (# released/# tries) | Printer Release |
|---|---|---|
| Control 8 | 0/4 | 5 |
| Example 11 | 4/4 | 1 |

The above results show that the release materials of the invention are also effective with other subbing agents.

The invention has been described in detail with particular reference to certain preferred embodiments thereof, but it will be understood that variations and modifications can be effected within the spirit and scope of the invention.

What is claimed is:

1. A dye-donor element for thermal dye transfer comprising a support having thereon a coextensive subbing layer and at least one dye layer area comprising an image dye in a binder and another area comprising a transferable protection layer, said transferable protection layer area being approximately equal in size to said dye layer area, said transferable protection layer having associated therewith a release material comprising a multi-hydroxyl compound, the alkali or alkaline earth metal salt of an alkyl diphenyloxide disulfonate, or an organic phosphate ester.

2. The element of claim 1 wherein said release material is glycerol, sorbitol or triethanolamine.

3. The element of claim 2 wherein said release material is present at a minimum concentration of at least about 0.01 $g/m^2$.

4. The element of claim 1 wherein said transferable protection layer comprises poly(vinyl acetal) or poly(methyl methacrylate).

5. The element of claim 1 wherein said subbing layer is a titanium alkoxide or a trialkoxy silane.

6. The element of claim 1 wherein said dye-donor element is a multicolor element comprising repeating color patches of yellow, magenta and cyan image dyes, respectively, dispersed in a binder, and a patch containing said protection layer.

7. The element of claim 1 wherein said release material is present in said transferable protection layer.

8. The element of claim 1 wherein said alkali or alkaline earth metal salt of an alkyl diphenyloxide disulfonate is sodium dodecyl diphenyloxide disulfonate.

9. A process of forming a protection layer on top of a thermal dye transfer image comprising:

(I) imagewise-heating a dye-donor element comprising a support having thereon a coextensive subbing layer and a dye layer comprising an image dye in a binder, said dye-donor being in contact with a dye-receiving element, thereby transferring a dye image to said dye-receiving element to form said dye transfer image; and (II) thermally transferring a protection layer on top of said transferred dye image, said transferable protection layer being applied from an element which contains a release material comprising a multi-hydroxyl compound, the alkali or alkaline earth metal salt of an alkyl diphenyloxide disulfonate, or an organic phosphate ester.

10. The process of claim 9 wherein said protection layer is present on a separate area of said dye-donor element.

11. The process of claim 9 wherein said protection layer is present on a separate donor element.

12. The process of claim 9 wherein said release material is glycerol, sorbitol or triethanolamine.

13. The process of claim 9 wherein said transferable protection layer comprises poly(vinyl acetal) or poly(methyl methacrylate).

14. The process of claim 9 wherein said subbing layer is a titanium alkoxide or a trialkoxy silane.

15. The process of claim 9 wherein said dye-donor element is a multicolor element comprising repeating color patches of yellow, magenta and cyan image dyes, respectively, dispersed in a binder, and a patch containing said protection layer.

16. The process of claim 9 wherein said alkali or alkaline earth metal salt of an alkyl diphenyloxide disulfonate is sodium dodecyl diphenyloxide disulfonate.

17. A thermal dye transfer assemblage comprising (A) a dye-donor element for thermal dye transfer comprising a support having thereon a coextensive subbing layer and at least one dye layer area comprising an image dye in a binder and another area comprising a transferable protection layer, said transferable protection layer area being approximately equal in size to said dye layer area, and (B) a dye receiving element comprising a support having thereon a dye image-receiving layer, said dye-receiving element being in a superposed relationship with said dye-donor element so that said dye layer is in contact with said dye image-receiving layer; said transferable protection layer containing a multi-hydroxyl compound, the alkali or alkaline earth metal salt of an alkyl diphenyloxide disulfonate, or an organic phosphate ester.

18. The assemblage of claim 17 wherein said release material is glycerol, sorbitol or triethanolamine.

19. The assemblage of claim 17 wherein said transferable protection layer comprises poly(vinyl acetal) or poly(methyl methacrylate).

20. The assemblage of claim 17 wherein said dye-donor element is a multicolor element comprising repeating color patches of yellow, magenta and cyan image dyes, respectively, dispersed in a binder, and a patch containing said protection layer.

* * * * *